US006570347B2

(12) United States Patent
Kastner

(10) Patent No.: US 6,570,347 B2
(45) Date of Patent: May 27, 2003

(54) GAS-DISCHARGE LAMP HAVING BRIGHTNESS CONTROL

(75) Inventor: Mark A. Kastner, New Berlin, WI (US)

(73) Assignee: Everbrite, Inc., Greenfield, WI (US)

( * ) Notice: Subject to any disclaimer, the term of this patent is extended or adjusted under 35 U.S.C. 154(b) by 0 days.

(21) Appl. No.: 09/870,347

(22) Filed: May 30, 2001

(65) Prior Publication Data

US 2002/0047630 A1 Apr. 25, 2002

Related U.S. Application Data

(60) Provisional application No. 60/208,518, filed on Jun. 1, 2000.

(51) Int. Cl.[7] ..... G05F 1/00

(52) U.S. Cl. ..... 315/307; 315/200 R; 315/224; 315/DIG. 4; 315/DIG. 7

(58) Field of Search ..... 315/307, 291, 315/244, 219, 200 R, 224, DIG. 4, DIG. 5, 209 R, 276, 282, 360, DIG. 7

(56) References Cited

U.S. PATENT DOCUMENTS

| | | | | |
|---|---|---|---|---|
| 3,569,775 | A | 3/1971 | Halstad et al. | 315/105 |
| 3,898,516 | A | 8/1975 | Nakasone | 315/194 |
| 3,990,000 | A | 11/1976 | Digneffe | 315/292 |
| 3,999,100 | A | 12/1976 | Dendy et al. | 315/308 |
| 4,087,722 | A | 5/1978 | Hancock | 315/200 A |
| 4,170,747 | A | 10/1979 | Holmes | 315/307 |
| 4,182,503 | A | 1/1980 | Muscatell | 315/248 |
| 4,219,760 | A | 8/1980 | Ferro | 315/224 |
| 4,221,994 | A | 9/1980 | Friedman et al. | 315/224 |
| 4,238,710 | A | 12/1980 | Nelson | 315/307 |
| 4,358,716 | A | 11/1982 | Cordes et al. | 315/306 |
| 4,371,812 | A | 2/1983 | Widmayer | 315/291 |
| 4,430,628 | A | 2/1984 | Nilssen | 331/113 A |
| 4,463,287 | A | 7/1984 | Pitel | 315/291 |
| 4,464,610 | A | 8/1984 | Pitel | 315/291 |
| 4,504,779 | A | 3/1985 | Haman | 323/349 |
| 4,523,129 | A | 6/1985 | Pitel | 315/291 |
| 4,523,130 | A | 6/1985 | Pitel | 315/291 |
| 4,529,913 | A | 7/1985 | Brosillon | 315/224 |
| 4,633,161 | A | 12/1986 | Callahan et al. | 323/242 |
| 4,663,570 | A | 5/1987 | Luchaco et al. | 315/219 |
| 4,680,536 | A | 7/1987 | Roszel et al. | 323/221 |
| 4,823,069 | A | 4/1989 | Callahan et al. | 323/235 |
| 4,885,508 | A | 12/1989 | Krokaugger | 315/287 |
| 4,891,828 | A | 1/1990 | Kawazoe | 377/114 |
| 4,894,587 | A | 1/1990 | Jungreis et al. | 315/200 R |
| 4,933,605 | A | 6/1990 | Quazi et al. | 315/224 |
| 4,949,020 | A | 8/1990 | Warren et al. | 315/297 |
| 5,023,518 | A | 6/1991 | Mans et al. | 315/219 |
| 5,038,081 | A | 8/1991 | Maiale, Jr. et al. | 315/291 |
| 5,107,184 | A | 4/1992 | Hu et al. | 315/291 |

(List continued on next page.)

*Primary Examiner*—Don Wong
*Assistant Examiner*—Thuy Vinh Tran
(74) *Attorney, Agent, or Firm*—Michael Best & Friedrich LLP

(57) ABSTRACT

A gas-discharge lamp and method of operating the lamp for controlling the brightness of the lamp. The lamp includes a drive for supplying a varying signal in response to receiving first and second control signals. The method includes establishing a time period; for a first interval of the time period, generating a first control signal having a first duty cycle and generating a second control signal having a second duty cycle; and, for a second interval of the time period, generating a third control signal having a third duty cycle, and generating a fourth control signal having a fourth duty cycle. The third duty cycle is less than the first duty cycle, and the fourth duty cycle is less than the second duty cycle. The first and third control signals are provided to a first switch and the second and fourth control signals are provided to a second switch.

19 Claims, 6 Drawing Sheets

U.S. PATENT DOCUMENTS

| | | | | |
|---|---|---|---|---|
| 5,155,415 | A | | 10/1992 | Schmidt et al. ..... 315/224 |
| 5,177,409 | A | | 1/1993 | Nilssen ..... 315/293 |
| 5,179,324 | A | | 1/1993 | Audbert ..... 315/194 |
| 5,191,262 | A | | 3/1993 | Nilssen ..... 315/209 R |
| 5,231,320 | A | | 7/1993 | Kase ..... 307/605 |
| 5,245,253 | A | | 9/1993 | Quazi ..... 315/224 |
| 5,268,616 | A | | 12/1993 | Dean et al. ..... 323/246 |
| 5,268,631 | A | | 12/1993 | Gorman et al. ..... 315/77 |
| 5,319,301 | A | | 6/1994 | Callahan et al. ..... 323/235 |
| 5,365,148 | A | | 11/1994 | Mallon et al. ..... 332/110 |
| 5,561,351 | A | | 10/1996 | Vrionis et al. ..... 315/248 |
| 5,565,820 | A | | 10/1996 | Peyrotte et al. ..... 332/110 |
| 5,581,158 | A | | 12/1996 | Quazi ..... 315/149 |
| 5,629,607 | A | | 5/1997 | Callahan et al. ..... 323/237 |
| 5,672,941 | A | | 9/1997 | Callahan et al. ..... 315/194 |
| 5,757,145 | A | | 5/1998 | Johnson et al. ..... 315/308 |
| 5,777,503 | A | | 7/1998 | Faulk ..... 327/323 |
| 5,821,700 | A | | 10/1998 | Malvaso ..... 315/291 |
| 5,841,246 | A | | 11/1998 | Manders ..... 315/307 |
| 5,861,720 | A | | 1/1999 | Johnson ..... 315/291 |
| 5,861,721 | A | | 1/1999 | Johnson ..... 315/291 |
| 5,939,830 | A | | 8/1999 | Praiswater ..... 315/DIG. 4 |
| 5,949,197 | A | | 9/1999 | Kastner ..... 315/291 |
| 6,040,661 | A | * | 3/2000 | Bogdan ..... 315/224 |
| 6,137,240 | A | * | 10/2000 | Bogdan ..... 315/247 |

* cited by examiner

GAS-DISCHARGE LAMP HAVING BRIGHTNESS CONTROL

RELATED APPLICATION

This application claims priority to U.S. Provisional Patent Application No. 60/208,518, entitled RAMPED DUTY CYCLE DIMMING, filed Jun. 1, 2000.

BACKGROUND OF THE INVENTION

The invention relates to a gas-discharge lamp having brightness control, and particularly to a gas-discharge lamp including a circuit that provides duty-cycle shifting for brightness control.

It is desirable to control the intensity of a neon sign or other gas-discharge lamp application. This requires some sort of variable power source to drive the lamp. Neon power sources are typically one of two types: a neon transformer, or a neon power supply. A neon transformer steps up the utility voltage, and drives the neon lamps at utility frequency (50 or 60 Hz). A neon power supply rectifies the line voltage to form DC rail voltages, inverts the rail voltages at relatively high frequency (typically 20–100 kHz), and drives a small step up transformer that drives the tube. The present invention deals with a neon power supply.

Numerous methods have been used in an attempt to dim a neon lamp powered from a neon power supply. Some methods attempt to reduce the energy delivered to the tube on a continuous basis. One method includes reducing the DC rail voltages to the inverter. This and similar methods suffer from a common disadvantage; when dimmed, the center of large neon signs becomes dimmer than the sections electrically close to the incoming power. This is thought to result from capacitive losses along the length of the gas discharge tube.

One dimming method that gives the greatest range of dimming, with no significant difference in intensity along the length of the tube, is pulse group modulation (PGM, refer to FIG. 1). For PGM, the inverter is operated at full input voltage and optimum frequency (e.g., 20 kHz) for a first interval 15 of a time period 5 (i.e., a first group of pulses 10 is generated for a first interval 15). The inverter is then "shut off" for a second interval 25 of the time period 5 (i.e., no group of pulses 20 is generated in the second interval 25). The result is groups of drive pulses being delivered to the transformer and to the tube load. The on and off pulsing is continuously performed at a sufficiently high repetition rate to prevent the perception of flickering (about 100–200 Hz). The overall repetition rate is kept constant, while the lengths of the first and second intervals 15 and 25 are varied to implement dimming. The lamp is at full intensity when the ON interval 15 occupies the entire time period 5, and the lamp is off when the OFF interval 25 occupies the entire time period 5. In between lies a smooth range of dimming from off to fully bright. For a 200 Hz repetition rate and a 20 kHz drive frequency, it is possible to achieve 100 brightness steps, with good visual performance at all steps.

Pulse group modulation suffers from one major drawback. The step-up transformer oscillates at the pulse group repetition rate, producing a loud, annoying buzz. A subtler drawback of PGM dimming is that at lower brightness levels, the tube may extinguish and re-ignite with each pulse group. This continuous re-ionization generates radiation EMI.

One prior art method used to combat the above problems is frequency shift key (FSK) dimming (see FIG. 2). FSK dimming entails producing a first group of pulses 35 for a first interval 40 of a time period 45 (referred to as the "on" portion or mode), ramping to a higher pulse frequency during a second interval 55, producing a second group of pulses 60 for a third interval 65 (referred to as the "off" portion or mode), and ramping down to the frequency of the first group of pulses 35 in a fourth interval 75. The transformer and tube are continuously driven, but with a much lower energy transfer efficiency during the "off" portion 60. By varying the amount of time spent in the normal high efficiency "on" mode 45 and the low efficiency "off" mode 55, the sign can be progressively dimmed. Also, since the transformer is continuously driven, the audible noise generated by the pulse group repetition is dramatically reduced.

FSK dimming suffers from one major drawback. The continuously changing drive frequencies generate a wide spectrum of electromagnetic interference (EMI) noise, making EMI filtering difficult. However, since FSK dimming continuously drives the tube, it is always ignited, and re-ignition radiated EMI is not a concern.

SUMMARY OF THE INVENTION

Accordingly, in one embodiment, the invention provides a gas-discharge lamp connectable to a power source and to a gas-discharge tube for controlling brightness of the tube. The lamp includes a drive having first and second switches. The drive is configured to receive direct current (DC) power, receive control signals, and invert the DC power to create a first varying signal in response to the control signals. The lamp further includes a transformer interconnected to the drive. The transformer transforms the first varying signal to a second varying signal; the second varying signal is supplied to the tube. The lamp further includes a controller interconnected to the drive. The controller generates the control signals for a time period and provides the control signals to the first and second switches. The generating of the control signals includes for a first interval of the time period, generating a first control signal with a first duty cycle, the first control signal being provided to the first switch, and generating a second control signal with a second duty cycle, the second control signal being provided to the second switch, and, for a second interval of the time period, generating a third control signal with a third duty cycle, the third control signal being provided to the first switch, and generating a fourth control signal with a fourth duty cycle, the fourth control signal being provided to the second switch. The third duty cycle is less than the first duty cycle, and the fourth duty cycle is less than the second duty cycle. The generation of the control signals just described is referred to herein as duty-cycle shifting (DCS).

The invention also provides a method of controlling the brightness of a gas-discharge lamp including a power supply. The power supply includes a drive having first and second switches. The drive supplies a varying signal in response to receiving control signals. The method includes establishing a time period; for a first interval of the time period, generating a first control signal having a first duty cycle and providing the first control signal to the first switch, and generating a second control signal having a second duty cycle and providing the second control signal to the second switch; and, for a second interval of the time period, generating a third control signal having a third duty cycle and providing the third control signal to the first switch, and generating a fourth control signal having a fourth duty cycle and providing the fourth control signal to the second switch. The third duty cycle is less than the first duty cycle, and the fourth duty cycle is less than the second duty cycle.

Duty-cycle shifting, like pulse group modulation, shares the advantage of a very large dynamic range. The neon sign can be dimmed from full brightness down to a very low intensity. This is accomplished without some of the undesirable effects of prior art dimming methods. For example, duty-cycle shifting prevents uneven dimming along the length of the tube, and prevents extinguishing or de-ionization of the tube. Other features and advantages of the invention will become apparent to those skilled in the art upon review of the following detailed description, claims, and drawings.

Before any embodiments of the invention are explained in full detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

DETAILED DESCRIPTION

Figure 1:
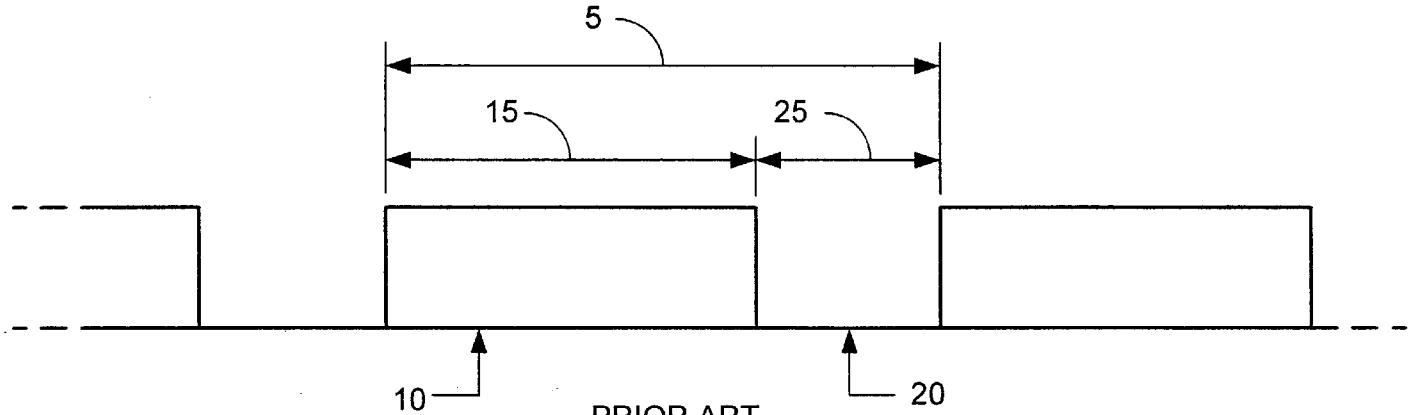
PRIOR ART FIG. 1
FIG. 1 is a schematic diagram representing the prior art pulse group modulation control of a gas-discharge lamp power supply.
Figure 2:
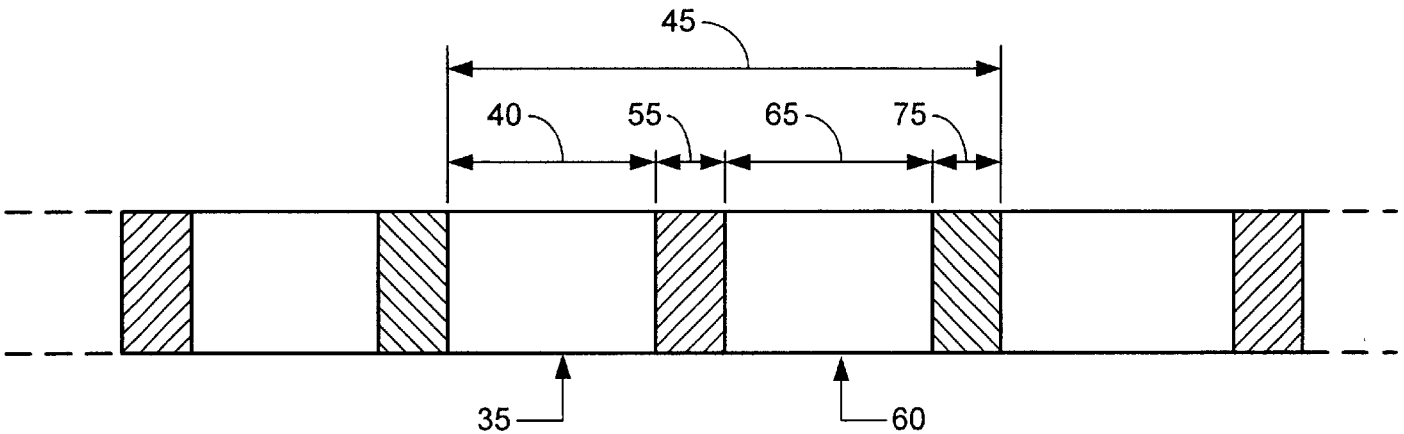
PRIOR ART FIG. 2
FIG. 2 is a schematic diagram representing the prior art frequency-shift-key dimming control for a gas-discharge lamp power supply.
Figure 3:
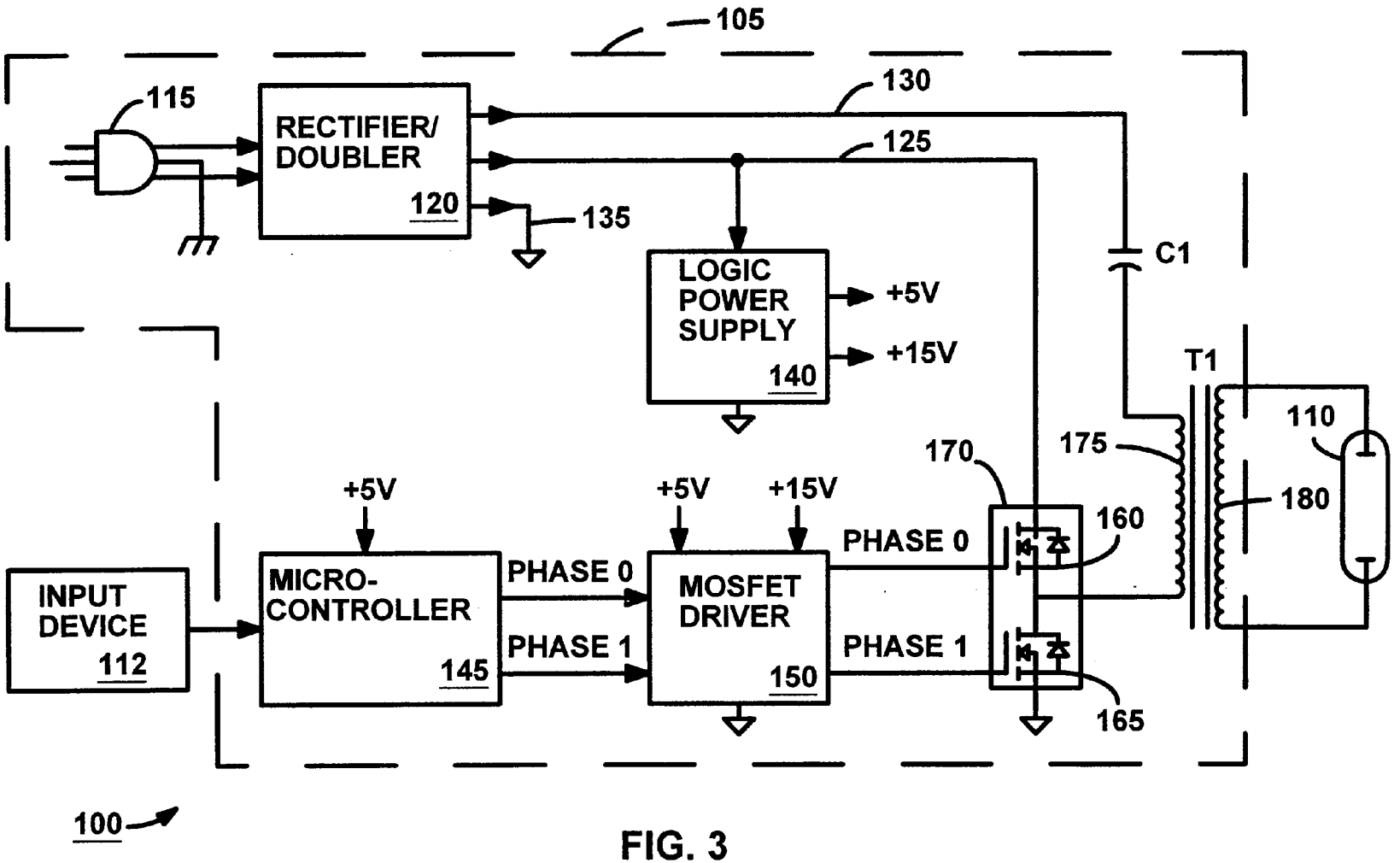
FIG. 3 is a schematic representation of a gas-discharge lamp of the invention.

A gas-discharge lamp 100 of the invention is schematically shown in FIG. 3 Although the description herein is for a neon sign, other gas-discharge lamps or gas-discharge signs may be used with the invention. The gas-discharge lamp 100 of the invention generally includes a power supply 105, a load 110, and an input device 112.

As shown in FIG. 3, the power supply 105 includes a plug 115 that connects to a power source. The power source may be a 120-volt, alternating current (VAC) power source or a 240-VAC power source. The power from the power source is provided to a rectifier/doubler circuit 120, which is well known in the art. The power from the power source is rectified and doubled (if a 120-VAC source) to form a high-voltage rail 125 (e.g., 340-VDC), an intermediate-voltage rail 130 (e.g., 170-VDC), and low-voltage rail 135 (e.g., 0-VDC). Although a rectifier/doubler circuit 120 is shown, for 240-VAC applications, only a bridge rectifier is required. Further, the voltages of the high-voltage, intermediate-voltage, and low-voltage rails 125, 130 and 135 may vary.

A logic power supply 140 is electricafly interconnected to the high-voltage rail 125, and creates one or more bias-voltages (e.g., a 5-VDC low-bias voltage, and/or a 15-VDC high-bias voltage) for powering logic components. The logic components include a microcontroller 145 and a MOSFET driver 150 for driving first and second MOSFETs 160 and 165. The microcontroller 145 (also referred to herein as the "controller") includes a processor and a memory. The memory includes one or more software modules having instructions. The processor retrieves, interprets, and executes the instructions to control the MOSFET driver 150 for driving the load 110. The contents of the software instructions will become apparent in the description below. The microcontroller 145 generates control signals for driving or controlling MOSFETs 160 and 165. The control signals (discussed further below) are communicated along lines phase0 and phase1. The control signals are transformed by the MOSFET driver 150 to an increased voltage for controlling the MOSFIETs 160 and 165. That is, the control signals are provided from the microcontroller 145 to the MOSFET driver 150, which generates drive signals having an increased voltage for controlling the first and second MOSFETs 160 and 165. The drive signals are communicated from the MOSFET driver 150 to the MOSFETs along lines phase0 and phase1.

The first and second MOSFETs 160 and 165 are connected in a half H-bridge configuration (also referred to as a power MOSFET half-bridge drive 170). The first MOSFET 160 is connected to the high-voltage rail 125, the bridge center is connected to a primary side 175 of a transformer T1, and the second MOSFET 165 is connected to the low-voltage rail 135 (also referred to as circuit common). The other end of primary winding 175 of transformer T1 is connected to a resonant capacitor C1, which is connected to the intermediate rail 130. The capacitor C1 and the primary winding 175 create an RC resonant circuit. The power MOSFET half-bridge drive 170 drives the transformer T1 with a varying signal (e.g., an AC signal with a DC offset) at a desired output frequency. The signal at the primary winding 175 is reflected at a secondary winding 180 with a desired output voltage. The components of the power supply 105 are well-known to one of ordinary skill in the art, and may be implemented using discrete circuitry, integrated circuitry, and a microprocessor and memory.

The load 110 includes at least one gas-tube interconnected with the secondary winding 180 of the transformer T1. For the embodiment shown, the load 110 is a single neon tube driven by the power supply 105 at a voltage and a frequency. The voltage and frequency applied to the load 110 varies depending on the frequency applied by the power MOSFET half-bridge circuit to the RC circuit.

The input device 112 provides an interface allowing an operator to control the lamp 100, including entering a desired lamp brightness level. The input device may further allow the operator to enter other commands such as lamp flashing, lamp fading, and similar features. Example input devices 112 include trim knobs, push buttons (including keyboards and keypads), switches, and other similar input devices.

In operation, an operator activates the lamp by inserting the plug 115 into the power source and turning a master switch ON. Upon activation, power provided by the power source is rectified (and doubled) by the rectifier/doubler 120. The rectified power is provided to logic power supply 140, which generates the low and high bias voltages. The microcontroller 145 receives the low bias voltage, and initializes the processor and memory. Upon initializing the processor, the one or more software modules are recalled from memory. The processor interprets and executes instructions of the one or more software modules, resulting in the microcontroller generating control signals phase0 and phase1 (discussed further below). The control signals are provided to the MOSFET driver 150 on lines phase0 and phase1, and the driver 150 controls the first and second MOSFETs 160 and 165 in response thereto. The MOSFET driver 150 generates drive signals. Each drive signal has a relationship (i.e., an increased voltage) to a corresponding control signal generated by the microcontroller 145. Thus, the drive signals communicated along lines phase0 and phase1 are essentially the same as the control signals communicated along lines phase0 and phase1, and may also be referred to as control signals. The signals communicated along lines phase0 and phase1 are provided to the power half bridge drive 170, resulting in a first varying signal. The first varying signal is provided to primary winding 175 and is transferred to the secondary winding 180. The transferred signal results in a second varying signal having a desired root-mean-square (RMS) voltage and a desired frequency. As is known in the art, the RMS voltage and frequency provided to the load is based in part on, or has a relationship to, the control signals phase0 and phase1 generated by the microcontroller 145. Forte embodiment shown, the signals communicated along lines phase0 and phase1 are determined by the one or more software modules stored in memory.

Figure 4:
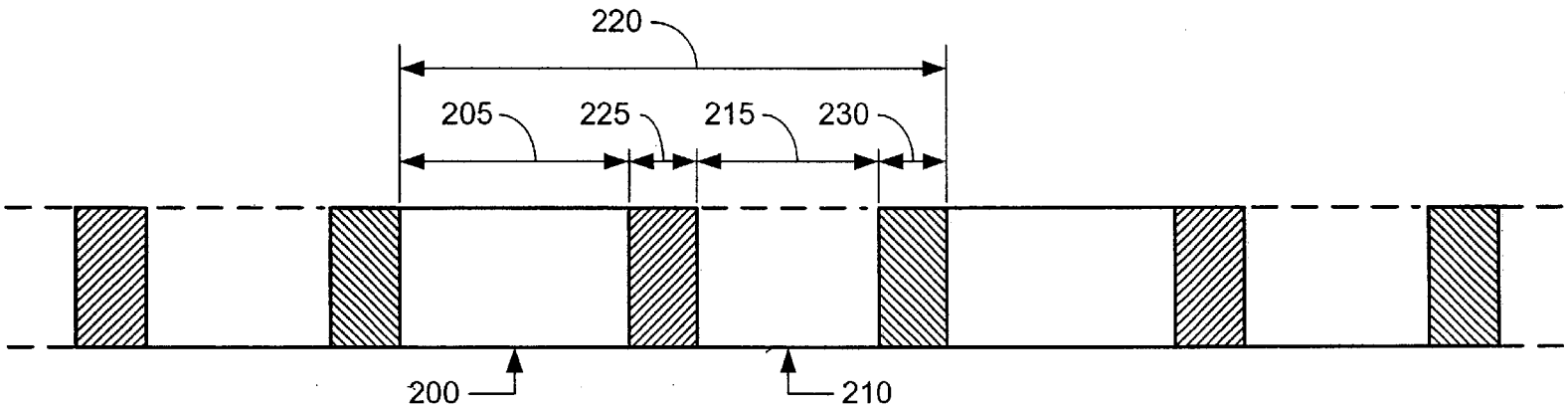
FIG. 4 is a schematic diagram representing duty-cycle shifting and duty-cycle transition for a gas-discharge lamp power supply.

The software modules of the invention use duty-cycle shifting for controlling the intensity of the lamp. As schematically shown in FIG. 4, for duty-cycle shifting (DCS), the drive 170 is operated at full input voltage, optimum frequency, and full-duty cycle (e.g., a ninety percent to one hundred percent duty cycle) for a first interval of a time period, and then operated at full input voltage, optimum frequency, and low-duty cycle (e.g., one percent to ten percent duty cycle) for a second interval of the time period. That is, a first group of pulses 200 having a full-duty cycle is generated for a first time interval 205, and then a second group of pulses 210 having a low-duty cycle is generated for a second time interval 215. The first interval is referred to as an "on" portion or mode, and the second interval is referred to as an "off" portion or mode. The "on" and "off" pulsing is referred to as duty-cycle shifting because the duty cycle is shifted from a first duty cycle to a second duty cycle and vice-versa. Although the description and drawings herein have the second interval being after the first interval, one skilled in the art will realize that the first interval may be after the second interval. In other words, the drive may be operated at full input voltage, optimum frequency, and low-duty cycle for an initial interval of the time period, and then operated at full input voltage, optimum frequency, and full-duty cycle for a later interval of the time period. The pulsing is continuously performed at a sufficiently high repetition rate to prevent the perception of flickering (about 100–200 Hz.). The repetition rate of the DCS signal sets the time period (also referred to as the repetition period 220) of the signal, and the lengths of the first and second intervals 205 and 215 are varied to implement dimming control. The lamp is at full intensity when the "on" interval 205 occupies the entire repetition period 220 and the lamp is at its lowest intensity when the "off" period interval 215 occupies the entire time period.

DCS provides a dynamic range for the operator to set. The range is determined in part by the duty-cycle of the "on" mode and the duty cycle of the "off" mode. The lamp can be dimmed from full brightness down to a very low intensity. However, because the "off" mode still applies a varying signal to the tube 110, the tube 110 does not de-ionize or extinguish during the "off" mode. The result is that some minimum amount of energy is continuously delivered to the tube load, which helps prevent it from de-ionizing. Since the re-ionizing of the tube causes a large voltage spike on the tube, it can be a significant source of EMI. Thus, unlike PGM, EMI noise is reduced due to the tube 110 not re-ionizing during each "on" portion. In other words, the tube is continuously driven, eliminating the problem of re-ignition radiated EMI noise.

In the embodiment shown, the first group of pulses 200 are driven at an optimum or "on" duty cycle, where the "on" duty cycle is substantially close to one hundred percent, and the second group of pulses are driving at a minimum or "off" duty cycle, where the "off" duty cycle is substantially close to zero percent. However, it is envisioned that the duty cycles during the "on" and "off" intervals may vary.

In addition to using DCS, the software modules of the invention use duty-cycle transitioning (may be referred to as "duty-cycle ramping") for controllably changing or transitioning the output duty cycle of the inverter. In duty-cycle transitioning (DCT), the duty cycle changes from a first duty cycle to a second duty cycle. The transitioning occurs over a time interval, rather than occurring abruptly. The transitioning from the first duty cycle to the second duty cycle may be in a linear or non-linear manner.

Referring again to FIG. 4, during a third time interval 225, the duty cycle of the signal supplied to the transformer T1 is controllably transitioned from the "on" duty cycle to the "off" duty. In one embodiment, the length of the third interval 225 is fixed and is approximately ten percent of the repetition period. During a fourth interval 230, the duty cycle of the signal supplied to the transformer T2 is controllably transitioned from the "off" duty cycle to the "on" duty cycle. In one embodiment, the length of the fourth interval 230 is fixed and is approximately ten percent of the repetition period. The transitioning of the duty cycle and constant frequency operation allows the transformer to operate at very low audible noise levels, while providing great brightness control performance. Although the description and drawings herein have the third interval being after the first interval and the fourth interval being after the second interval, one skilled in the art will realize that the location of the third and fourth intervals may vary.

Figure 5:
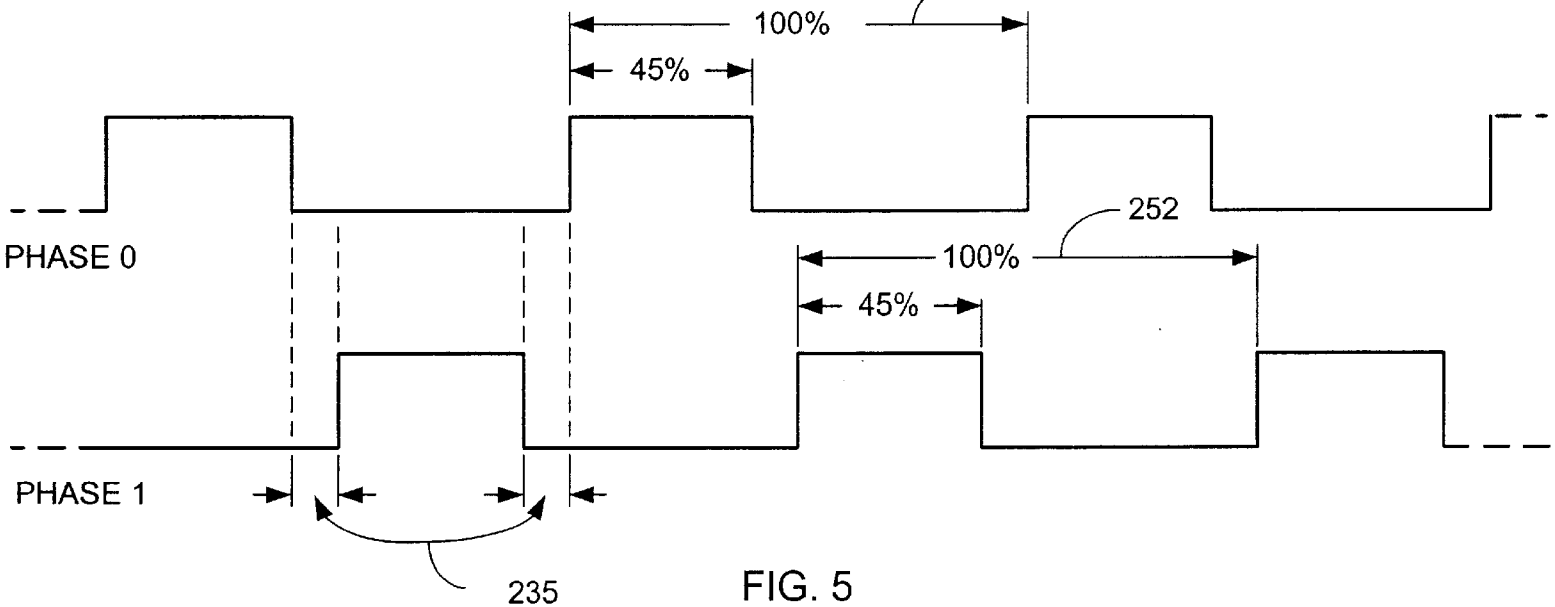
FIG. 5 is a schematic diagram representing control signals being communicated along lines phase0 and phase1 over time, the control signals having a balanced duty cycle.

The optimum waveform to excite mercury-argon tubes is a balanced drive, where the duty cycle of the control signals (e.g., first control signal 250 and second control signal 252) are the same. A balance drive prevents mercury migration in a mercury tube. FIG. 5 shows the control signals during the "on" interval 200. As schematically shown in FIG. 5, the control signals (including the first control signal 250) communicated on line phase0, which controls control MOSFET 160, have a duty cycle of approximately forty-five percent, and the control signals (including the second control signal 252) communicate online phase1, which control MOSFET 165, have a duty cycle of approximately forty-five percent. These two signals result in the drive 170 generating a varying signal having a duty cycle of approximately ninety percent. The varying signal generated by the drive 170 has a frequency (e.g., 20–100 kHz) substantially larger than the repetition rate (e.g., 100–200 Hz). In addition, for the embodiment shown, the control signals include off-periods 235 allowing each MOSFET 160 and 165 to properly prevent current flow before the other MOSFET 160 or 165 allows current flow. Using optimal dead bands 235 reduces MOSFET heating by virtually eliminating cross-conduction energy that must be absorbed by the MOSFETs 160 and 165. Conversely, the prior art dimming scheme typically require that the power MOSFETs run with non-optimum heating one hundred percent of the time generating excessive heat.

Figure 6:
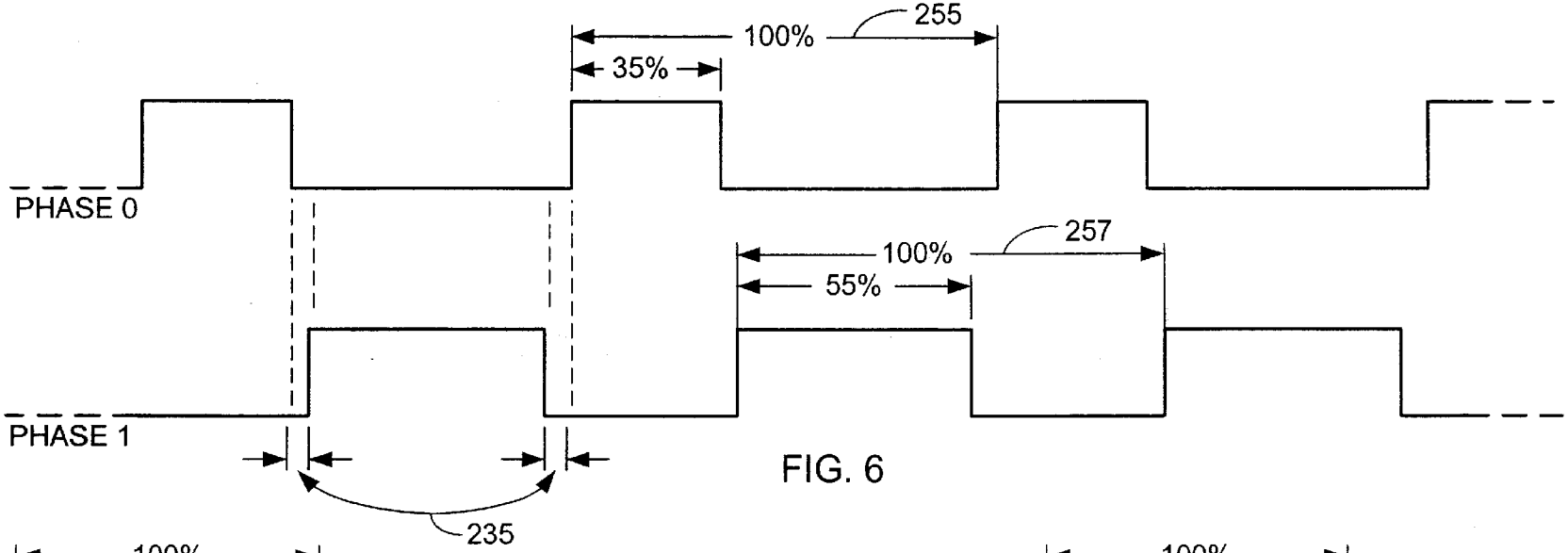
FIG. 6 is a schematic diagram representing control signals being communicated along lines phase0 and phase1, the control signals having an unbalanced duty cycle.

Unlike mercury-argon tubes, a balanced drive for a neon tube causes the neon tubes to form plasma bubbles. One method for preventing plasma bubbles is to generate an offset varying drive signal with the drive 170. As schematically shown in FIG. 6, the control signals (including the first control signal 255) communicated on line phase0, which control MOSFET 160, have a duty cycle of approximately thirty-five percent, and the control signals (including the second control signal 257) communicated on line phase1, which control MOSFET 165, have a duty cycle of approximately fifty-five percent. The control signals shown in FIG. 6 result in the drive 170 generating a varying signal having a duty cycle of approximately ninety percent. In addition to preventing plasma bubbles, the polarity of the offset drive may be periodically reversed to prevent mercury migration.

Figure 7:
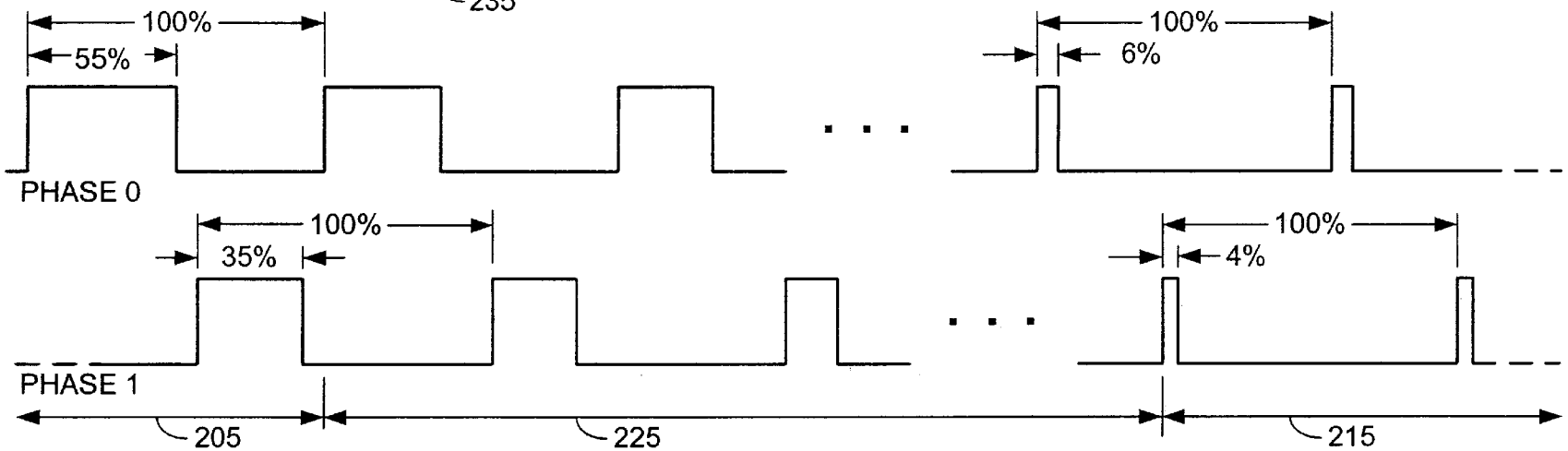
FIG. 7 is a schematic diagram representing control signals being communicated along lines phase0 and phase 1, the control signals reducing from a first duty cycle to a third duty cycle and a second duty cycle to a fourth duty cycle.
Figure 8:
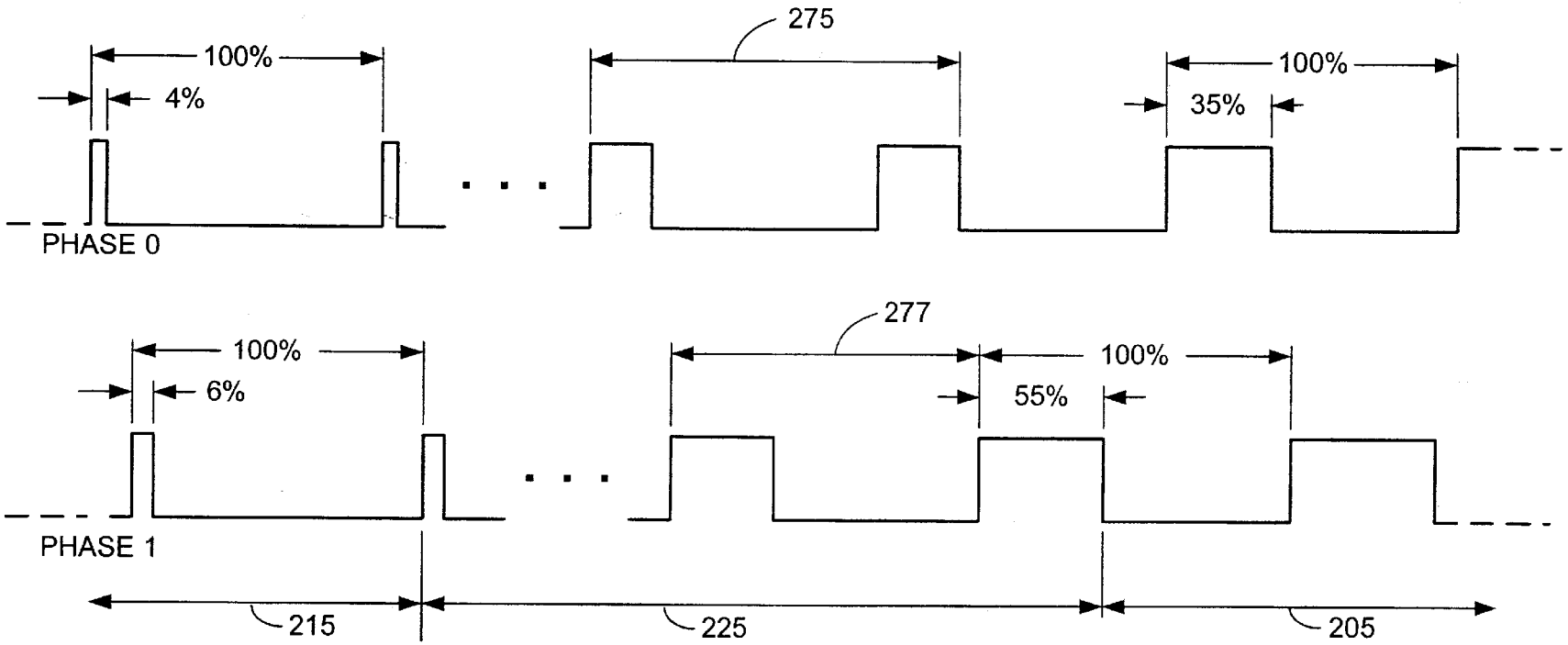
FIG. 8 is a schematic diagram representing control signals being communicated along lines phase0 and phase1, the control signals increasing from a third duty cycle to a first duty cycle and a fourth duty cycle to a second duty cycle.
Figure 9:
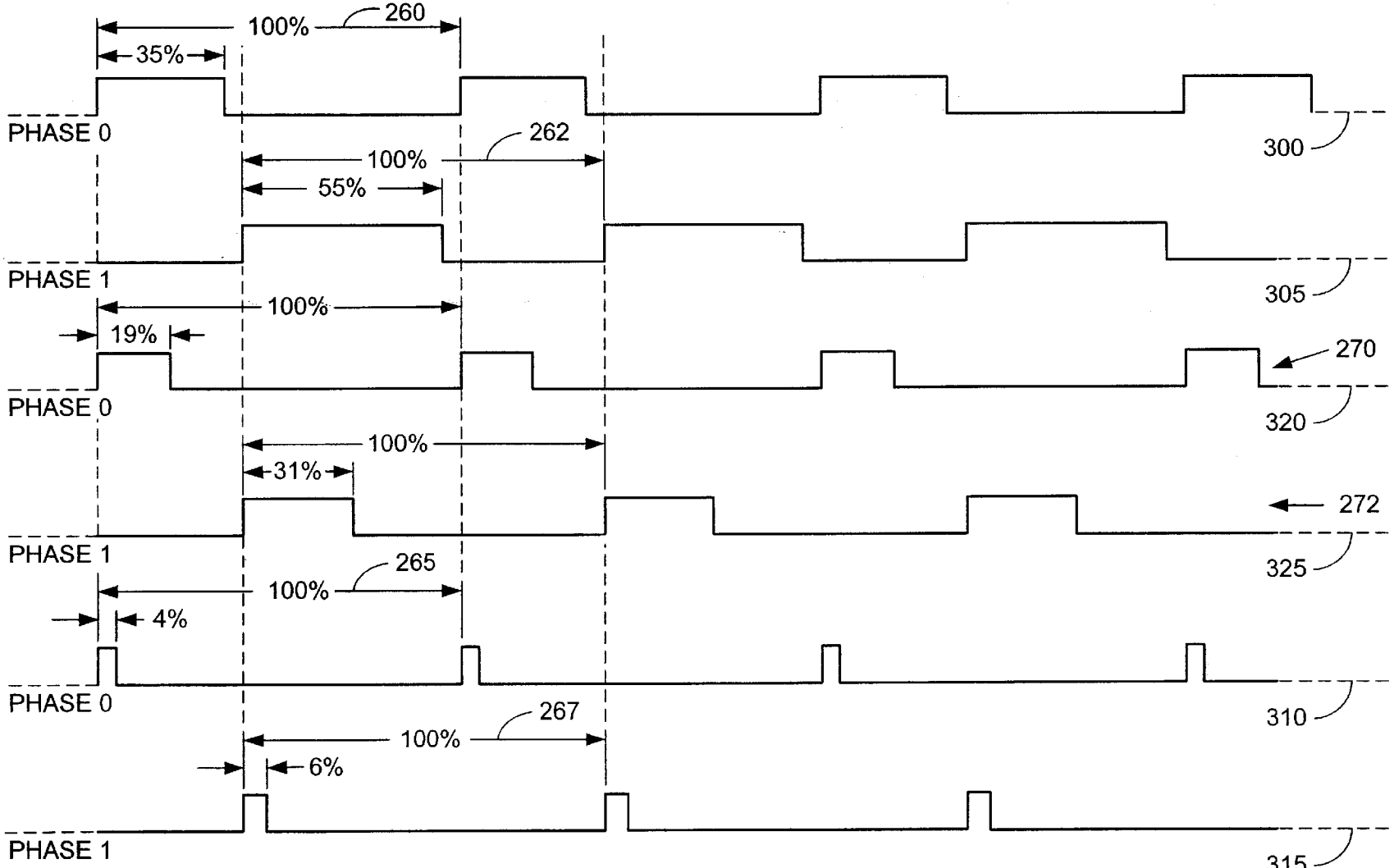
FIG. 9 is a schematic diagram representing control signals during separate time intervals, the control signals being communicated along lines phase0 and phase1, the control signals.

In one embodiment of DCS, the ratio in duty cycles communicated along lines phase0 and phase1 (e.g., thirty-five percent and fifty-five percent) is maintained through the "off" period. This allows the minimum possible disruption in the drive timing, and thereby minimizes emitted audible noise. For a specific example and referring to FIG. 7, the signals communicated on line phase0 are controllably transitioned from thirty-five percent to four percent and the signals communicated on line phase1 are controllably transitioned from fifty-five percent to six percent. These two signals result in the drive 170 generating a varying signal that transition from ninety percent to ten percent. Referring to FIG. 8, the signals communicated on line phase0 is are controllably transitioned from four percent to thirty-five percent and the control signal signals communicate on line phase1 are controllably transitioned from six percent to fifty-five percent. These two signals result in the drive 170 generating a varying signal that transition from a ten percent duty cycle to a ninety percent duty cycle. FIG. 9 overlaps the phase0 and phase1 control signals at three different locations in the repetition period 220. The lines 300 and 305 show offset control signals (including first control signal 260 having a first duty cycle and second control signal 262 having a second duty cycle) communicated on lines phase0 and phase1 during the first interval 205. The lines 310 and 315 show offset control signals (including third control signal 265 having a third duty cycle and fourth control signal 267 having a fourth duty cycle) communicated on lines phase0 and phase1 during the second interval 215. The lines 320 and 325 show offset control signals mid-way through either the third or fourth intervals 225 or 230. Line 320 includes a first set of control signals 270 that transition from the first duty cycle to the third duty cycle (e.g., from 35% to 4%) and line 340 includes a second set of control signals 272 that transition from the second duty cycle to the fourth duty cycle (e.g., from 55% to 6%). Transitioning the shifting of the duty cycles results in an audibly quieter lamp than straight PGM. Rather that suddenly being started and stopped, the waveform is slowly ramped on and off at the beginning and end of pulse groups. As discussed earlier for FIG. 8, the repetition period can include a fourth interval. The fourth interval includes a third set of control signals (including, for example, control signal 275) that transition from the third duty cycle to the first duty cycle (e.g., from 4% to 35%) and includes a fourth set of control signals (including, for example, control signal 277) that transition from the fourth duty cycle to the second duty cycle (e.g., from 55% to 6%).

Although the changing waveforms are generated with a microcontroller 145 having a processor executing software instructions, other microcontrollers (e.g., integrated circuits) may be used. In addition, other options of manipulating the output waveform are possible. For example, as the unit is gradually brightened, it remains in DCS up until the step right before full intensity. At that point, it switches to constant duty cycle mode, which allows the lamp 100 to maximize the output intensity. This substantially eliminates all audible noise, since there is no longer any dimming frequency present. In another embodiment, to achieve maximum brightness, it may be desirable to eliminate the transition interval at the highest brightness level. In addition, the software modules may include software instructions for implementing other optional features, such as fading, and flashing.

DCS intensity control is very suitable for variable dimming. The inventor has determined that it is possible to have over one hundred dimming steps. FSK dimming requires a longer frequency transition interval than the duty cycle transition interval required by DCS. The result is a reduction in dimming range. Thus, DCS has a greater dynamic range than FSK dimming.

As can be seen from the above, the invention provides a new and useful gas-discharge lamp having brightness control. Various features and advantages of the invention are set forth in the following claims.

What is claimed is:

1. A method of controlling the brightness of a gas-discharge lamp including a power supply, the power supply including a drive having first and second switches, the drive supplying a varying signal in response to control signals being provided to the first and second switches, the method comprising:

establishing a repetition period;

for a first interval of the repetition period, generating a first control signal having a first duty cycle and providing the first control signal to the first switch, and generating a second control signal having a second duty cycle and providing the second control signal to the second switch;

for a second interval of the repetition period, generating a third control signal having a third duty cycle and providing the third control signal to the first switch, the third duty cycle being less than the first duty cycle, and generating a fourth control signal having a fourth duty cycle and providing the fourth control signal to the second switch, the fourth duty cycle being less than the second duty cycle; and repeating the repetition period, thereby controlling the brightness of the lamp.

2. A method as set forth in claim 1 wherein the first and second duty cycles are approximately the same, and wherein the third and fourth duty cycles are approximately the same.

3. A method as set forth in claim 1 and further comprising:

determining a lamp brightness; and detennining a length of the first and second intervals corresponding to the lamp brightness.

4. A method as set forth in claim 3 and further comprising:

determining a second lamp brightness; and determining the first and second intervals corresponding to the second lamp brightness.

5. A method as set forth in claim 1 and further comprising:

for a third interval of the repetition period, generating a first set of additional control signals and providing the first set of additional control signals to the first switch, each additional control signal of the first set having a duty cycle, respectively, the duty cycles of the first set of additional control signals transitioning from the first duty cycle to the third duty cycle, and generating a second set of additional control signals and providing the second set of additional control signals to the second switch, each additional control signal of the second set having a duty cycle, respectively, the duty cycles of the second set of additional control signals transitioning from the second duty cycle to the fourth duty cycle.

6. A method as set forth in claim 1 and further comprising:

for a third interval of the repetition period, generating a first set of additional control signals and providing the first set of additional control signals to the first switch, each additional control signal of the first set having a duty cycle, respectively, the duty cycles of the first set of additional control signals transitioning from the third duty cycle to the first duty cycle, and generating a second set of additional control signals and providing the second set of additional control signals to the second switch, each additional control signal of the second set having a duty cycle, respectively, the duty cycles of the second set of additional control signals transitioning from the fourth duty cycle to the second duty cycle.

7. A method as set forth in claim 1 and further comprising:

for a third interval of the repetition period, generating a first set of additional control signals and providing the first set of additional control signals to the first switch, each additional control signal of the first set having a duty cycle, respectively, the duty cycles of the first set of additional control signals transitioning from the first duty cycle to the third duty cycle, and generating a second set of additional control signals and providing the second set of additional control signals to the second switch, each additional control signal of the second set having a duty cycle, respectively, the duty cycles of the second set of additional control signals transitioning from the second duty cycle to the fourth duty cycle; and for a fourth interval of the repetition period, generating a third set of additional control signals and providing the third set of additional control signals to the first switch, each additional control signal of the third set having a duty cycle, respectively, the duty cycles of the third set of additional control signals transitioning from the third duty cycle to the first duty cycle, and generating a fourth set of additional control signals and providing the fourth set of additional control signals to the second switch, each additional control signal of the fourth set having a duty cycle, respectively, the duty cycles of the fourth set of additional control signals transitioning from the fourth duty cycle to the second duty cycle.

8. A method as set forth in claim 7 wherein the transitioning of the duty cycles is performed linearly.

9. A gas-discharge lamp connectable to a power source and to a gas-discharge tube for controlling a brightness of the tube, the lamp comprising:

a drive including first and second switches, the drive being configured to receive direct current (DC) power and invert the DC power in response to control signals, the inverting DC power resulting in a first varying signal;

a resonance circuit interconnected to the drive, the resonance circuit transforming the first varying signal to a second varying signal, the second varying signal being supplied to the tube;

a controller interconnected to the first and second switches, the controller generating the control signals for a repetition period, providing the control signals to the first and second switches, and repeating the repetition period, the generation of the control signals including:

for a first interval of the repetition period, generating a first control signal having a first duty cycle, the first control signal being provided to the first switch, and generating a second control signal having a second duty cycle, the second control signal being provided to the second switch, and for a second interval of the repetition period, generating a third control signal having a third duty cycle, the third duty cycle being less than the first duty cycle and the third control signal being provided to the first switch, and generating a fourth control signal having a fourth duty cycle, the fourth duty cycle being less than the second duty cycle and the fourth control signal being provided to the second switch.

10. A lamp as set forth in claim 9 and further comprising:

a rectifier connectable to the power source, the rectifier being operable to receive alternating current (AC) power from the power source and rectifying the AC power to DC power.

11. A lamp as set forth in claim 9 wherein the first and second switches include first and second metal-oxide-semiconductor-field-effect transistors (MOSFET), respectively, and wherein the first and second switches are connected in a half H-bridge configuration.

12. A lamp as set forth in claim 9 wherein the controller includes a processor and memory, the memory having one or more software modules executable by the processor.

13. A lamp as set forth in claim 9 wherein the first and second duty cycles are approximately the same, and wherein the third and fourth duty cycles are approximately the same.

14. A lamp as set forth in claim 9 and further comprising:

an input device operable to receive a desired lamp brightness from an operator; and wherein the controller determines a length of the first and second intervals corresponding to the first lamp brightness.

15. A lamp as set forth in claim 9 wherein the controller generates the control signals for the repetition period including:

for a third interval of the repetition period, generating a first set of additional control signals to be provided to the first switch, each additional control signal of the first set having a duty cycle, respectively, the duty cycles of the first set of additional control signals transitioning from the first duty cycle to the third duty cycle, and generating a second set of additional control signals to be provided to the second switch, each additional control signal of the second set having a duty cycle, respectively, the duty cycles of the second set of additional control signals transitioning from the second duty cycle to the fourth duty cycle.

16. A lamp as set forth in claim 9 wherein the controller generates the control signals for the repetition period including:

for a third interval of the repetition period, generating a first set of additional control signals to be provided to the first switch, each additional control signal of the first set having a duty cycle, respectively, the duty cycles of the first set of additional control signals transitioning from the third duty cycle to the first duty cycle, and generating a second set of additional control signals to be provided to the second switch, each additional control signal of the second set having a duty cycle, respectively, the duty cycles of the second set of additional control signals transitioning from the fourth duty cycle to the second duty cycle.

17. A lamp as set forth in claim 9 wherein the controller generates the first and second control signals for the repetition period including:

for a third interval of the repetition period, generating a first set of additional control signals to be provided to the first switch, each additional control signal of the first set having a duty cycle, respectively, the duty cycles of the first set of additional control signals transitioning from the first duty cycle to the third duty cycle, and generating a second set of additional control signals to be provided to the second switch, each additional control signal of the second set having a duty cycle, respectively, the duty cycles of the second set of additional control signals transitioning from the second duty cycle to the fourth duty cycle; and for a fourth interval of the repetition period, generating a third set of additional control signals to be provided to the first switch, each additional control signal of the third set having a duty cycle, respectively, the duty cycles of the third set of additional control signals transitioning from the third duty cycle to the first duty cycle, and generating a fourth set of additional control signals to be provided to the second switch, each additional control signal of the fourth set having a duty cycle, respectively, the duty cycles of the fourth set of additional control signals transitioning from the fourth duty cycle to the second duty cycle.

18. A lamp as set forth in claim 17 wherein the transitioning of the duty cycles is performed linearly.

19. A lamp as set forth in claim 9 wherein the resonance circuit includes a transformer, wherein the transformer transforms a first voltage of the first varying signal to a second voltage of the second varying signal, and wherein the second voltage is greater than the first voltage.

* * * * *